United States Patent [19]

Kakinaka

[11] 3,989,068

[45] Nov. 2, 1976

[54] AUTOMATIC CONTROL APPARATUS FOR WEAVING MACHINE

[75] Inventor: Arao Kakinaka, Nishinomiya, Japan

[73] Assignee: Toyo Boseki Kabushiki Kaisha, Japan

[22] Filed: Sept. 24, 1975

[21] Appl. No.: 616,176

[30] Foreign Application Priority Data

Sept. 28, 1974 Japan ..... 49-111861
Mar. 10, 1975 Japan ..... 50-29267

[52] U.S. Cl. ..... 139/353; 139/336; 139/370.1; 250/561

[51] Int. Cl.[2] ..... D03D 51/28

[58] Field of Search ..... 139/336, 341, 349, 352, 139/353, 370.1, 370.2; 28/51; 66/157; 250/559, 561, 562, 563

[56] References Cited

UNITED STATES PATENTS

| | | | |
|---|---|---|---|
| 3,379,225 | 4/1968 | Ichimi et al. | 139/353 |
| 3,608,590 | 9/1971 | Hohener | 139/336 |
| 3,697,732 | 10/1972 | Duss | 139/336 |
| 3,818,236 | 6/1974 | Lind et al. | 250/561 |
| 3,824,401 | 7/1974 | Suzuki | 250/561 |
| 3,863,241 | 1/1975 | Kamiyamaguchi et al. | 139/370.1 |

*Primary Examiner*—Henry S. Jaudon
*Attorney, Agent, or Firm*—Staas & Halsey

[57] ABSTRACT

An automatic control apparatus for a weaving machine is disclosed, which includes a photoelectric detecting scheme provided at a reed of the machine such that a light beam thereof penetrates the shed of the warp sheet and detects improperly shedded warp. A timing switch is coupled to a crank shaft for generating a timing signal at a predetermined angle of the crank shaft, and delay circuits are provided for delaying the timing signal so as to generate a gate control signal. The leading and/or trailing edges of the gate control signal are defined by the delay circuits and a gate circuit is included which is responsive to the gate control signal for allowing the warp detected signal to be gated. A wave shaping circuit receives the warp detected signal as gated and provides wave shaped signals thereof. A charge storing capacitor is connected to receive wave shaped signal, said the charge voltage thereof is threshold detected to provide a control signal. A control circuit is provided which is responsive to the gate control signal for stopping the weaving machine.

15 Claims, 11 Drawing Figures

AUTOMATIC CONTROL APPARATUS FOR WEAVING MACHINE

BACKGROUND OF THE INVENTION

1. Field of the Invention

The present invention relates to an automatic control apparatus for a weaving machine. More specifically, the present invention relates to on off improvement in an control apparatus for automatically stopping the operation of the weaving machine upon detection of improper shedding of the warp, such as intertwining of the wrap caused by shag thereof, suspension of snapped warp, or the like during the weaving operation of the weaving machine.

2. Description of the Prior Art

When the warp gets intertwined due to shag thereof or is snapped to be suspended during the weaving operation of the weaving machine, improper shedding of the warp is caused, which could result in a defect of the resultant fabric. Various apparatus for automatically detecting such improper shedding of the warp have been proposed. Of such prior art apparatuses, an apparatus of a type for detecting improper shedding of warp in a photoelectric manner is particularly preferred in view of the response rate of the operation thereof. Detailed disclosure of such a photoelectric detecting scheme for improper shedding of the warp is seen in the Japanese Pat. No. 773841, issued June 30, 1975 to the same assignee as the present invention, entitled "Automatic Control Apparatus for Weaving Machine", which was published for opposition Sept. 27, 1974 as Japanese Patent Publication No. 36071/1974.

FIG. 1 is a diagrammatical view showing an outline of a photoelectric detecting scheme for detecting improperly shedded warp, in which the present invention can be advantageously employed. The warp 1 and 2 undergoes the shedding motion by means of healds 3 and 4, while the fabric is woven and is transferred leftward. In FIG. 1 the warp 1' and 2' which have become intertwined with each other due to the shag is shown in the dotted line. A reed 5 is caused to make reciprocating motion by rotation of a crank shaft 6. A sleigh 7 is provided on a sleigh sword 8 and a light source 9 and a photoelectric device 10 are provided rearwardly of the reed 5 so as to be opposed to each other such that a light axis thereof penetrates the shed of the wrap. A cam 11 is fixedly provided to the crank shaft 6 such that a timing switch 12 is opened or turned off during a suitable time period of one rotation of the weaving machine, for example, during only the period when the above described photoelectric detecting scheme detects the shadow of the warp 1' and 2' which caused the improper shedding of the warp. The time period when the timing switch 12 is opened is selected to be about one seventh of one full rotation of the crank shaft 6, for example, from 80° to 130° of the rotational angle, or about one third to forth of one full rotation, for example, from 50° to 150° of the angle, in the embodiment of the present invention. The on/off operation of the switch 12 is utilized to provide a gate signal for transferring the warp detected signal obtainable by the photoelectric detecting scheme to the subsequent stage, as is more fully described hereinafter. The photoelectric detecting scheme is shown only by way of an example it is understood that many modifications for detecting the warp of improper shedding in a photoelectric manner can be implemented by those skilled in the art.

FIG. 2 is an illustration showing a detection range by means of the photoelectric detecting scheme of FIG. 1. The scheme has been implemented such that the warp of improper shedding can be detected at the range of 80° to 130° of the rotational angle of the crank shaft 6, (i.e., the timing switch 12 is opened by the cam 11 within the range of 80° to 130° of the rotational angle of the crank shaft 6). In such a situation the warp 1, which has been uppermost in the extreme shedding condition is liable not to be lined in the lateral direction, particularly in case of the fabric the warp of which is not easy of shedding in the nature thereof, with the result that some warp 1'' as shown in two dotted line is liable to be suspended. The suspended warp 1'' interrupts the light beam from the light source 9 at the said detection range of 80° to 130° and as a result a warp detected signal is obtained by the photoelectric device 10 as if improperly shedded warp were detected, notwithstanding the proper shedding of the warp in such a situation. As a result, the weaving machine is erroneously stopped automatically as if the warp of improper shedding had been detected, notwithstanding the proper shedding of the warp.

In order to avoid such a problem, those skilled in the art might think that the detection range and thus the opening range of the timing switch 12 should be shifted by 10°, for example, to 90° to 140° in terms of the rotational angle of the crank shaft 6. In fact, it might be possible that the chance of malfunction in response to the suspending warp 1'' is reduced which is particularly caused in case of the warp not easy of shedding. Nevertheless, it is necessary to change the angle and shape of the cam 11 with respect to the shaft in order to adjust the opening time period of the timing switch 12, although such change is extremely difficult. Assuming that the detection range is set to be 90° to 140° from the beginning, then another problem is encountered that weaving with undesired raised portion is liable to be caused in case of the fabric of ordinary warp in the nature.

SUMMARY OF THE INVENTION

Briefly stated, the present invention comprises an automatic control apparatus for a weaving machine wherein a warp sheet is shedded for each weaving operation comprising; means for detecting improperly sheaded warp sheet, means responsive to said weaving operation for generating a timing signal at a predetermined phase of said weaving operation, means responsive to said timing signal for providing a gate control signal, means provided in association with said gate control signal providing means for setting said phase of said gate control signal, means responsive to said gate control signal for gating said warp detecting output, and means responsive to an output from said gating means for automatically controlling the on/off operation of said weaving machine. The present invention eliminates any inconvenience caused by possible undesired detection of disordered warp by said warp detecting means at a certain range of the weaving operation phase irrespective of proper shedding of the warp depending upon the nature of the warp.

Therefore, a principal object of the present invention is to provide an automatic control apparatus for a weaving machine, wherein the detection range of the weaving operation phase for detection of the warp of improper shedding can be set depending upon the shedding nature of the warp to be used for the fabric.

Another object of the present invention is to provide an automatic control apparatus for a weaving machine wherein the detection range of the weaving operation phase for detection of the warp of improper shedding can be set by presetting the timing of initiation of the improper shedding detection depending upon the shedding nature of the warp to be used for the fabric.

These objects and other objects, features, aspects and advantages of the present invention will become more apparent from the following detailed description of the embodiments when taken in conjunction with the accompanying drawings.

DESCRIPTION OF THE PREFERRED EMBODIMENTS

Figure 1:
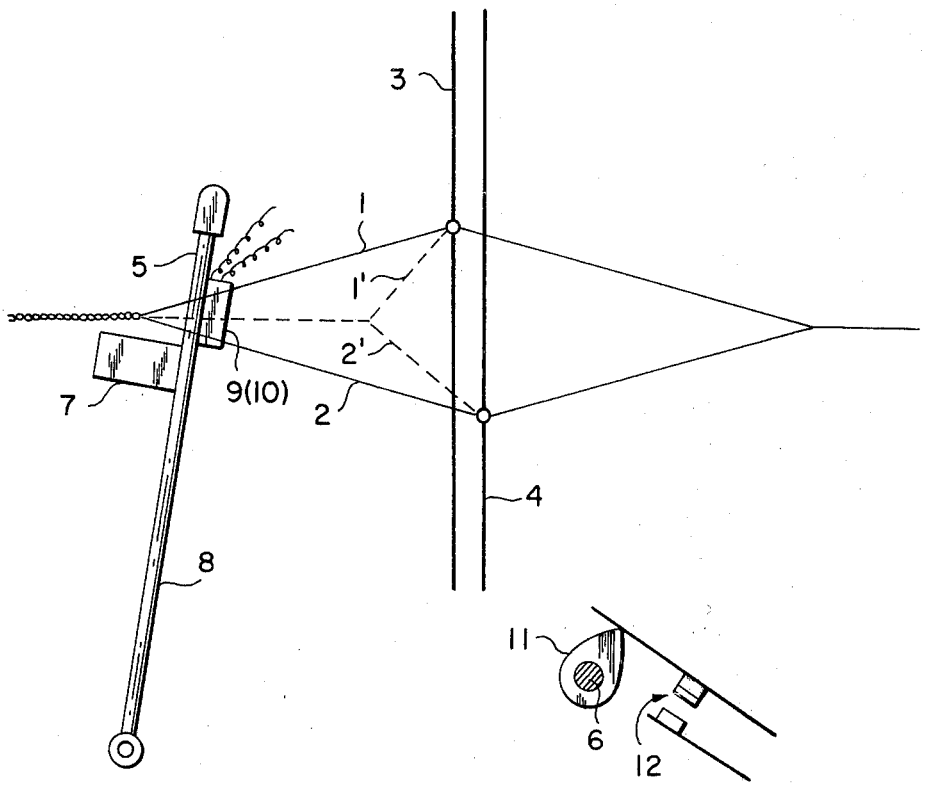
FIG. 1 is a diagrammatical view showing an outline of a photoelectric detecting scheme for detecting improperly shedded warp, in which the present invention can be advantageously employed.
Figure 2:
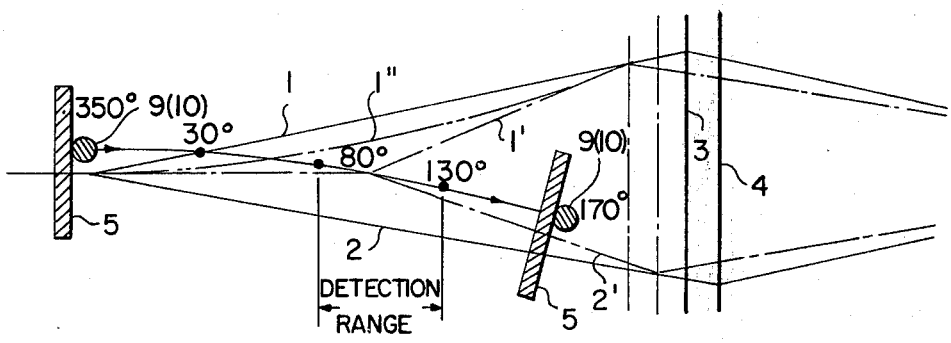
FIG. 2 is an illustration showing a detection range by means of the photoelectric detecting scheme of FIG. 1.
Figure 3:
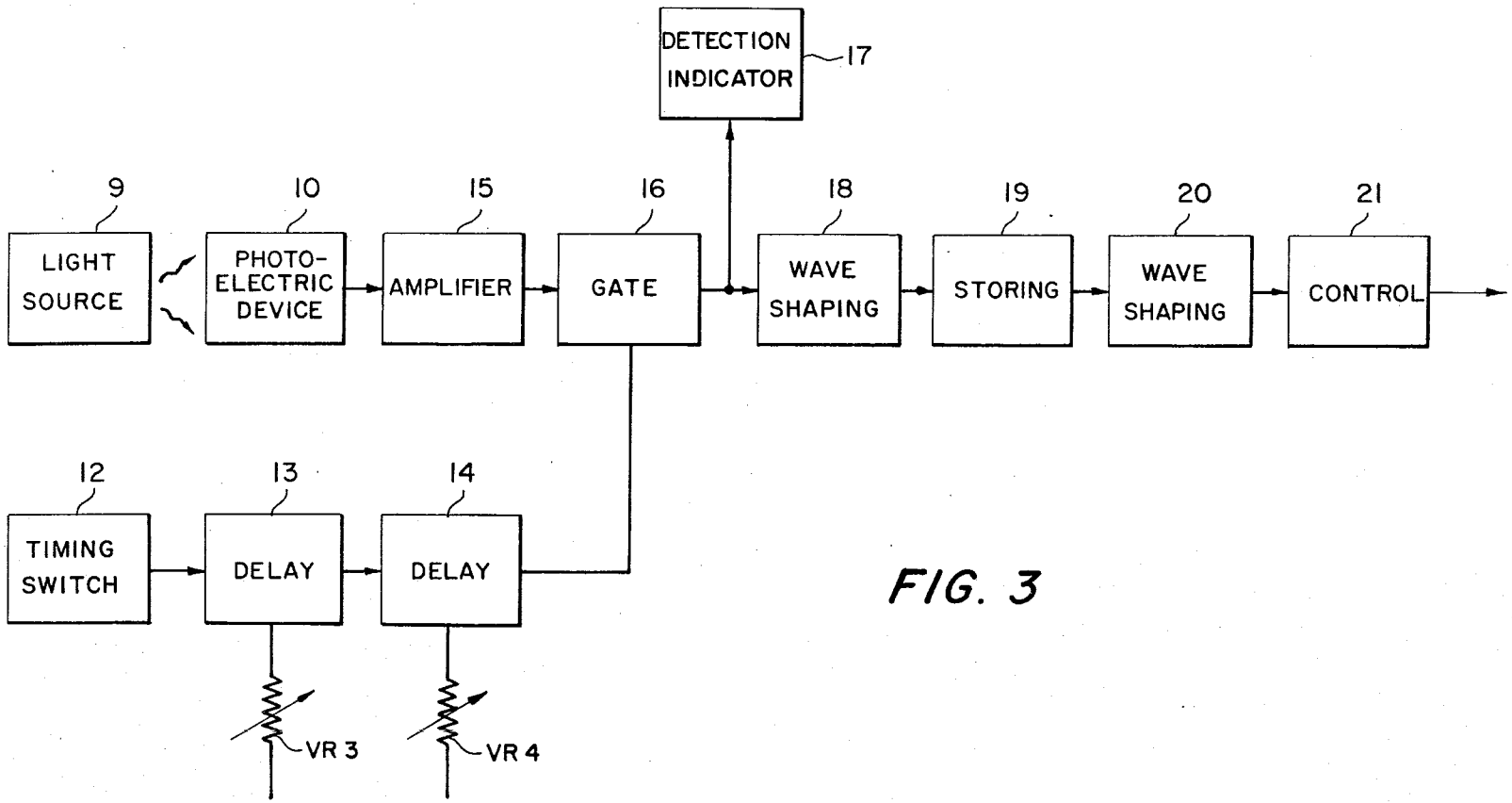
FIG. 3 is a block diagram of an embodiment of the present invention.

FIG. 3 is a block diagram of an embodiment of the present invention. The light beam obtainable from the light source 9 in FIGS. 1 and 2 is adapted to impinge on the photoelectric device 10. The photoelectric device 10 receives the light beam, detects a change in the light flux thereof, due to the interruption by the warp, and produces a warp detected signal. The warp detected signal is applied to an amplifier 15. An output from the amplifier 15 is applied to one input of a gate circuit 16.

A timing pulse from the timing switch 12 during the opening period of the switch is applied through two delay circuits 13 and 14 to the other input of the gate circuit 16 as an open/close control signal thereof and which constitute an essential feature of the embodiment shown. The two delay circuits 13 and 14 each may be implemented by a single-shot multivibrator, for example. One delay circuit 13 is aimed to vary or delay the rise time of the leading edge of the output pulse therefrom in response to the timing pulse by means of a variable resistor VR3, for example, and the other delay circuit 14 is aimed to vary or delay the fall time or the trailing edge of the output pulse therefrom in response to the timing pulse by means of a variable resistor VR4, for example. Thus, these two delay circuits 13 and 14 determine the open/close period of the gate circuit 16, open/close controllable by the timing pulse from the timing switch 12. More specifically, one delay circuit 13 is triggered by the leading edge of the timing pulse to provide the output pulse of the pulse width determined by the variable resistor VR3 and the subsequent delay circuit 14 is triggered by the trailing edge of the output pulse from the delay circuit 13 and the fall or trailing edge of the output pulse is set as desired by the variable resistor VR4. Accordingly, these two delay circuits 13 and 14 cooperate to set as desired the opening period of the gate circuit 16 to correspond to the timing pulse and time period (in terms of the rotational angle of the crank shaft) in which the warp detected signal caused by the disorder of the warp in the extreme shedding condition is applied to the subsequent circuits.

The warp detected signal from the photoelectric device 10 is applied to the warp detection indicator 17 comprised of a light emitting diode or the like through the gate circuit 16 opened by the output from the delay circuit 14, thereby to light the indicator 17. The warp detected signal; and is also applied to a wave shaping circuit 18, comprised of a single-shot multivibrator or the like. The output from the wave shaping circuit 18 is stored in a storing circuit 19. If and when the storing circuit 19 stores the wave shaped pulse signals commensurate with a predetermined number of warp detected signals, it provides an output to a wave shaping circuit 20 comprised of a single-shot multivibrator or the like, thereby to provide a control pulse output. A control circuit 21 comprising a relay, for example, is operative in response to the control pulse output, to thereby to stop operation of the weaving machine, for example.

Figure 4:
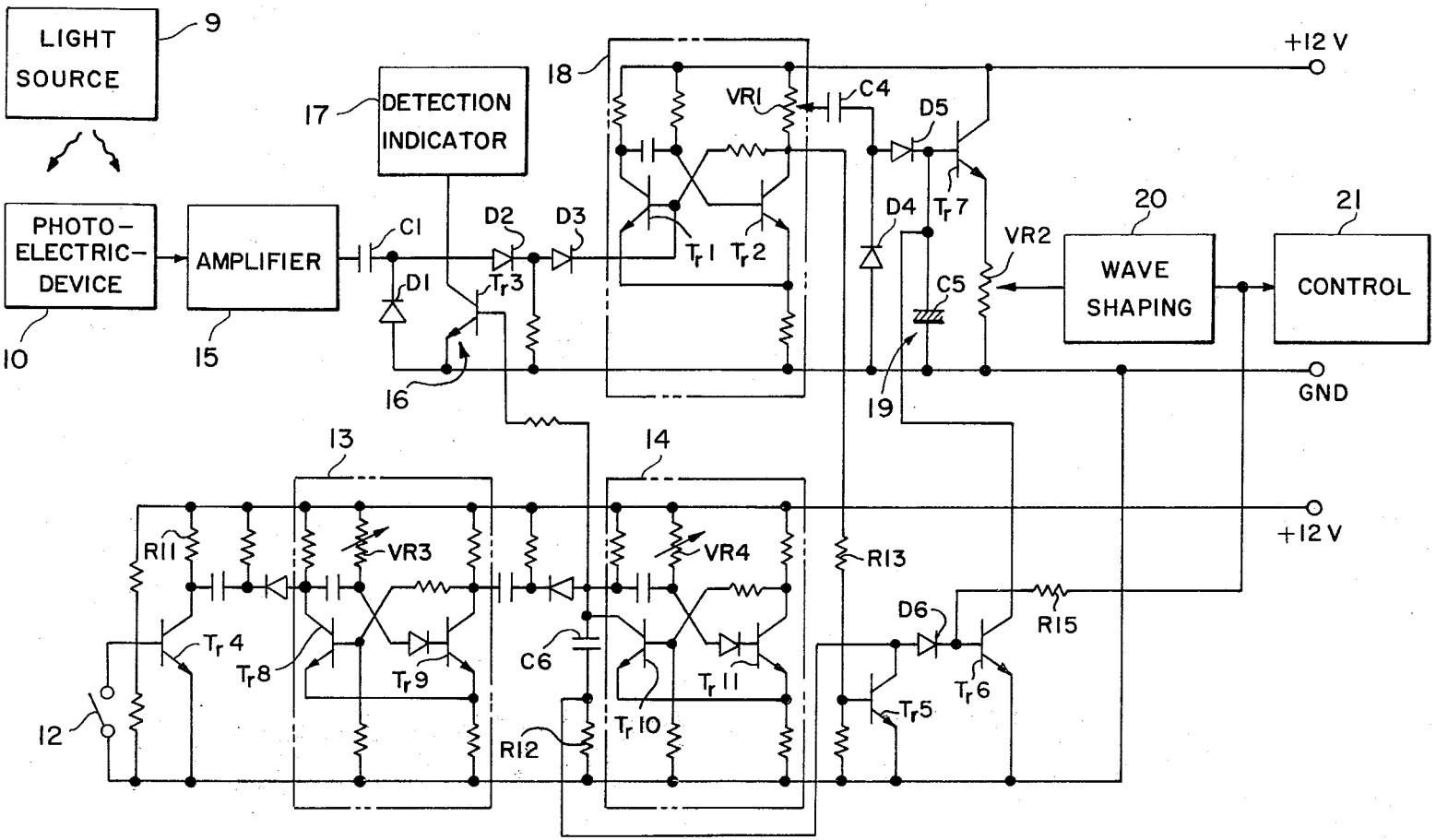
FIG. 4 is a schematic diagram of a preferred embodiment of the present invention, which shows the FIG. 3 embodiment in more detail.

FIG. 4 is a schematic diagram of a preferred embodiment of the present invention, which shows in more detail the FIG. 3 embodiment. The construction of the embodiment is described as follows with reference to FIG. 4. The detected signal from the photoelectric device 10 is applied to the amplifier 15 and the output therefrom is differentiated by a capacitor C1 only the positive going component of the differentiated output passes the diodes D2 and D3, and is further applied to the single-shot multivibrator constituting the wave shaping circuit 18. The diode D1 is connected between the junction of the capacitor C1 and the diode D2 with ground terminal GND in the polarity shown (i.e., in the reverse direction with response to the ground GND). A switching transistor T*r*3 constituting the gate circuit 16 is also connected between the junction and the ground terminal GND.

The timing switch 12 open/close controllable in association with the cam 1 in FIG. 1 is connected between the base electrode of a transistor T*r*4 and the ground terminal GND. The output from the transistor T*r*4 is applied to a single-shot multivibrator constituting the delay circuit 13. The output from the delay circuit 13 is applied to the single-shot multivibrator constituting the other delay circuit 14. The delay circuit 13 comprises the single-shot multivibrator implemented by the transistors T*r*8 and T*r*9 and includes a variable resistor VR3 for adjusting the pulse width of the output therefrom. The delay circuit 14 comprises the single-shot multivibrator implemented by transistors T*r*10 and T*r*11 and includes a variable resistor VR4 for adjusting the pulse width of the output therefrom. More specifically, the delay circuit 13 is triggered to rise in response to the rise of the output pulse (timing pulse) of the transistor T*r*4, and falls after the time period as adjusted by the variable resistor VR3. The delay circuit 14 is triggered in response to the fall of output pulse from the delay circuit 13 and falls after the lapse of the time period as adjusted by the variable resistor VR4. The output from the delay circuit 14 is applied to the base electrode of the gate transistor Tr3.

The above described wave shaping circuit 18 comprises the single-shot multivibrator implemented by transistors Tr1 and Tr2 and includes a variable resistor VR1 at the output thereof. Since the circuit configuration of single-shot multivibrators is generally well known to those skilled in the art, detailed description thereof is omitted. The time constant or the output time period of the multivibrator constituting the wave shaping circuit 18 is selected to be shorter than one full operation period when the weaving machine is being operated at the fastest speed, to thereby assure that even if the multivibrator becomes operable for each operation period at the fastest possible operation speed the consecutive output thereof may be separated without being overlapped. The output from the wave shaping circuit 18 is differentiated by a capacitor C4 and only the positive going component of the differentiated output passes the diodes D4 and D5. The positive going component, thus obtained, is applied to the base electrode of the transistor Tr7. A capacitor C5 is connected as a storing circuit 19 for the purpose of storing the differentiated output from the capacitor C4. The capacitor C5 is connected to the base of transistor Tr7 which is turned on for the first time when the predetermined number of differentiated output pulses are stored in the capacitor C5, thereby providing an output at its emitter. The output from the transistor Tr7 is applied to the wave shaping circuit 20 comprising a single-shot multivibrator. The wave shaping circuit 20 serves to convert the output from the storing circuit 20 to a pulse having a pulse width of say 3 seconds (the time period necessary to drive the control circuit 21 comprising the relay or the like). The output from the wave shaping circuit 20 drives the subsequent control circuit 21. The control circuit 21 comprises an output amplifying circuit connected to a relay for the purpose of stopping the operation of the weaving machine. Since such means to be provided at the subsequent stages of the control circuit 21 are well known to those skilled in the art and are not so closely related with the present invention, detailed description and illustration therefor are omitted.

A switching transistor Tr6 is connected to the base electrode of the transistor Tr7 for the purpose of discharging the quantity of electricity as charged in the capacitor C5. The base electrode of the transistor Tr6 is supplied with the output from the wave shaping circuit 20 through a resistor R15, so that the transistor Tr6 is turned on in response to the output from the wave shaping circuit 20, to thereby discharge the capacitor C5. The base electrode of the transistor Tr6 is also supplied with a differentiation output signal obtainable as a result of differentiation of the output from the collector of the transistor Tr9 by means of a capacitor C6 a resistor R12 and a diode D6 passes only the positive going component of the differentiated output. Another switching transistor Tr5 is connected to the base electrode of the transistor Tr6, and the base electrode of the transistor Tr5 is supplied with the output from the wave shaping circuit 18 through a resistor R13. Therefore, when an output is obtained from the wave shaping circuit 18, the transistor Tr5 is turned on and accordingly the base electrode of the transistor Tr6 is forced to the potential of the ground terminal GND, whereby the differentiated output signal from the capacitor C6 which might be obtained at that time is grounded. Thus, the differentiated output signal is effectively applied to the transistor Tr6, thereby to turn it on, only if and when no output is obtained from the wave shaping circuit 18.

Figure 5:
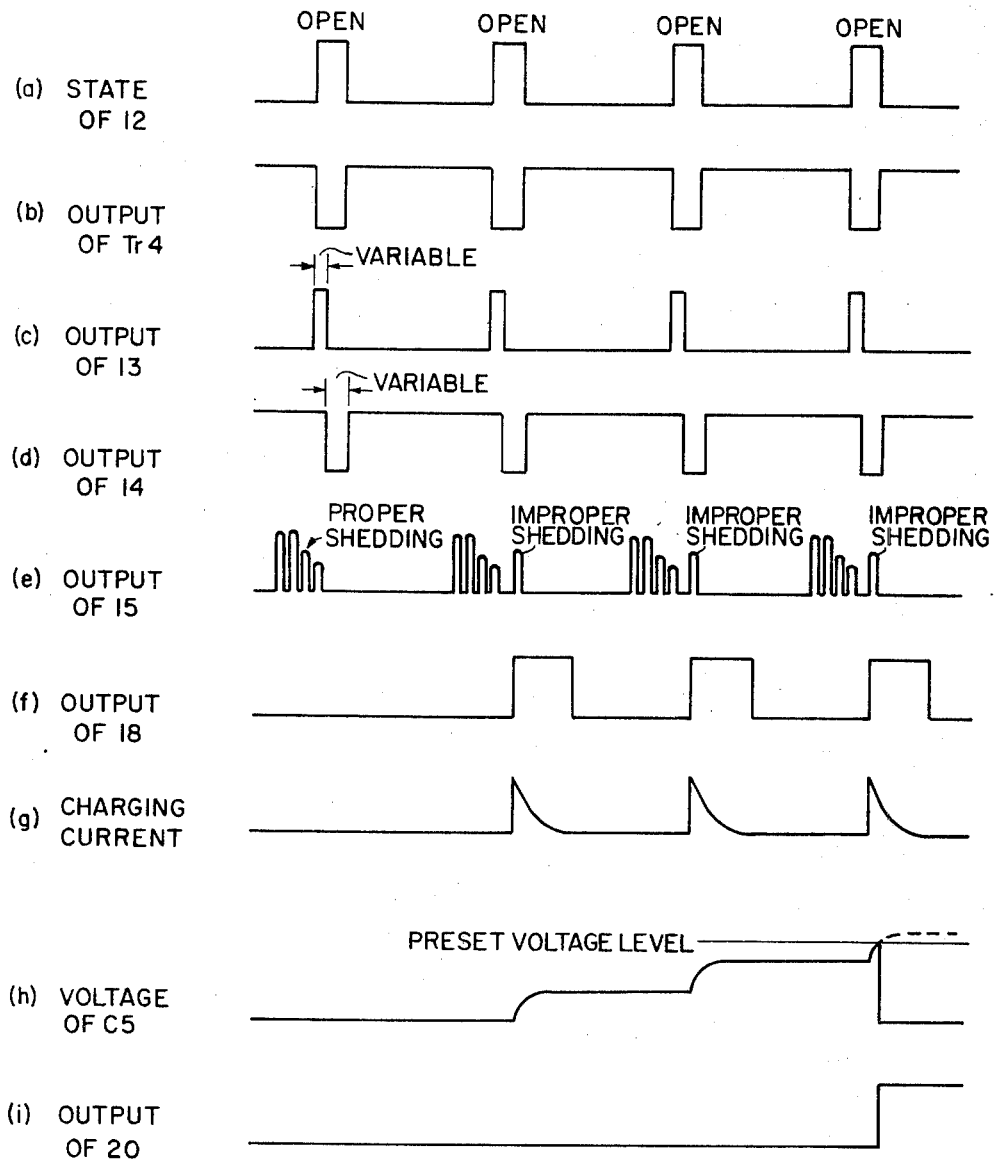
FIGS. 5 and 6 illustrate wave forms of the signals at various portions of the FIG. 4 circuit, for the purpose of explaining the operation thereof.

The operation of the FIG. 4 circuit can be better understood by referring to FIG. 5, which illustrates wave forms of the signals at various portions of the FIG. 4 circuit. It is pointed out that FIG. 5 illustrates the wave forms of the signals on the assumption that improper shedding occurred in succession for three or more consecutive weaving motion periods.

When the rotational angle of the crank shaft 6 (FIG. 1) reaches 80°, the timing switch 12 is opened as a function of the cam 11, and when the rotational angle of the crank shaft 6 reaches 130°, the timing switch 12 is again closed as a function of the cam 11. During the open period of the timing switch 12, the transistor Tr4 is turned on, thereby to provide a timing pulse as shown in FIG. 5(*b*). The output from the transistor Tr4 is differentiated by the subsequent differentiation capacitor and only the negative going component of the differentiated output is passed by the diode and is applied as a trigger input to the single-shot multivibrator of the delay circuit 13. Therefore, the delay circuit 13 provides the output pulse as shown in FIG. 5(*c*), the duration of which is determined by the variable resistor VR3. The output from the delay circuit 13 is differentiated by the differentiation capacitor C6 at the subsequent stage. The output from the differentiation capacitor C6 is rectified by the diode, to thereby pass only the negative going component of the differentiated output corresponding to the falling or the trailing edge of the output pulse from the delay circuit 13, which is applied as a trigger input to the single-shot multivibrator of the delay circuit 14. The delay circuit 14 provides the output pulse as shown in FIG. 5(*d*), the duration of which is determined by the variable resistor VR4. The output pulse from the delay circuit 14 is applied to the base electrode of the transistor Tr3 constituting the gate circuit 16, whereby the gate transistor Tr3 is turned off when the said output pulse is of the low level. As a result, the collector potential of the gate transistor Tr3 becomes dependent only on the output signal from the amplifier 15. More specifically, the output pulse from the delay circuit 14 causes the gate circuit 16 implemented by the transistor Tr3, to be opened. The gate transistor Tr3 is opened after a delay of the pulse width (about 10° in terms of the rotational angle of the crank shaft 6) of the delay circuit 13, since the timing switch 12 is opened at about 80° of the rotational angle of the crank shaft. The gate transistor Tr3 is closed at the end of the pulse width from the delay circuit 14, after a delay, since the opening of the timing switch 12 terminals is at about 130° of the rotational angle of the crank shaft.

The output from the photoelectric device 10 and thus the output from the amplifier 15 varies in response to the disorder of the warp, even in the case of the proper, to provide warp detected signal. However, the transistor Tr3 is turned off or the gate is opened after the delay of about 10° in terms of the rotational angle of the crank shaft from the beginning of the opening state of the timing switch 12. Therefore, the warp detected signal for the disorder of the warp in the case of proper shedding is not applied as a trigger input to the singleshot multivibrator of the wave shaping circuit 18. Accordingly, the capacitor C5 is not charged at all.

Assuming that a warp detected signal is obtained from the amplifier 15 in response to improper shedding of the warp, such a warp detected signal corresponding to the improperly shedded warp is obtained during the off period of the gate transistor T*r*3. Accordingly, the indicator 17 is energized to indicate the improper shedding of the warp, and the warp detected signal, due to the improperly shedded warp, is applied through the diodes D2 and D3 to the single-shot multivibrator of the wave shaping circuit 18 as a trigger signal thereof. Therefore, the wave shaping circuit 18 provides a pulse output as shown in FIG. 5(*f*), which rises in response to the incoming warp detected signal due to the improperly shedded warp.

The gate control signal output from the delay circuit 14 is differentiated by the capacitor C6 to provide a differentiated output across the resistor R12. The positive going component thereof is applied through the diode D6 to the base electrode of the transistor T*r*6. However, the output from the wave shaping circuit 18 causes the transistor T*r*5 to turn on during the output period thereof, thereby to force the base electrode of the transistor T*r*5 to the potential of the ground terminal GND, with the result that the transistor T*r*6 is not triggered by the positive going component of the differentiated output. Thus, the transistor T*r*6 remains off, so that the capacitor C5 is not discharged. Accordingly, the differentiated output obtained as a result of differentiation by the capacitor C4 of the output from the wave shaping circuit 18, charges the capacitor C5 in the wave form of the charging current as shown in FIG. 5(*g*). Variation of the charge voltage across the capacitor C5 is shown in FIG. 5(*h*). The charge voltage across the capacitor C5 is applied to the transistor T*r*7. However, the transistor T*r*7 has been so adjusted that it is turned on at the preset voltage level or the predetermined threshold level, as shown in FIG. 5(*h*). In the embodiment shown, the circuit of the transistor T*r*7 has been so designed that the charge voltage across the capacitor exceeds the preset level only if and when three incoming pulses charge the capacitor. When the charge voltage across the capacitor exceeds the preset level, the transistor T*r*7 is turned on and the wave shaping circuit 20 provides a pulse output having the pulse width of say three seconds. Therefore, the control circuit 21 including the relay is driven to perform the desired automatic stop operation. At the same time the output from the wave shaping circuit 20 is applied to the transistor T*r*6 through the resistor R15, so that the transistor T*r*6 is turned on. Therefore, the capacitor C5 is discharged to return to the initial condition. The number of the incoming pulses which charge the capacitor C5 to the charge voltage exceeding the above described preset level is adjusted by the variable resistor VR1 so as to vary the voltage of the output therefrom.

Figure 6:
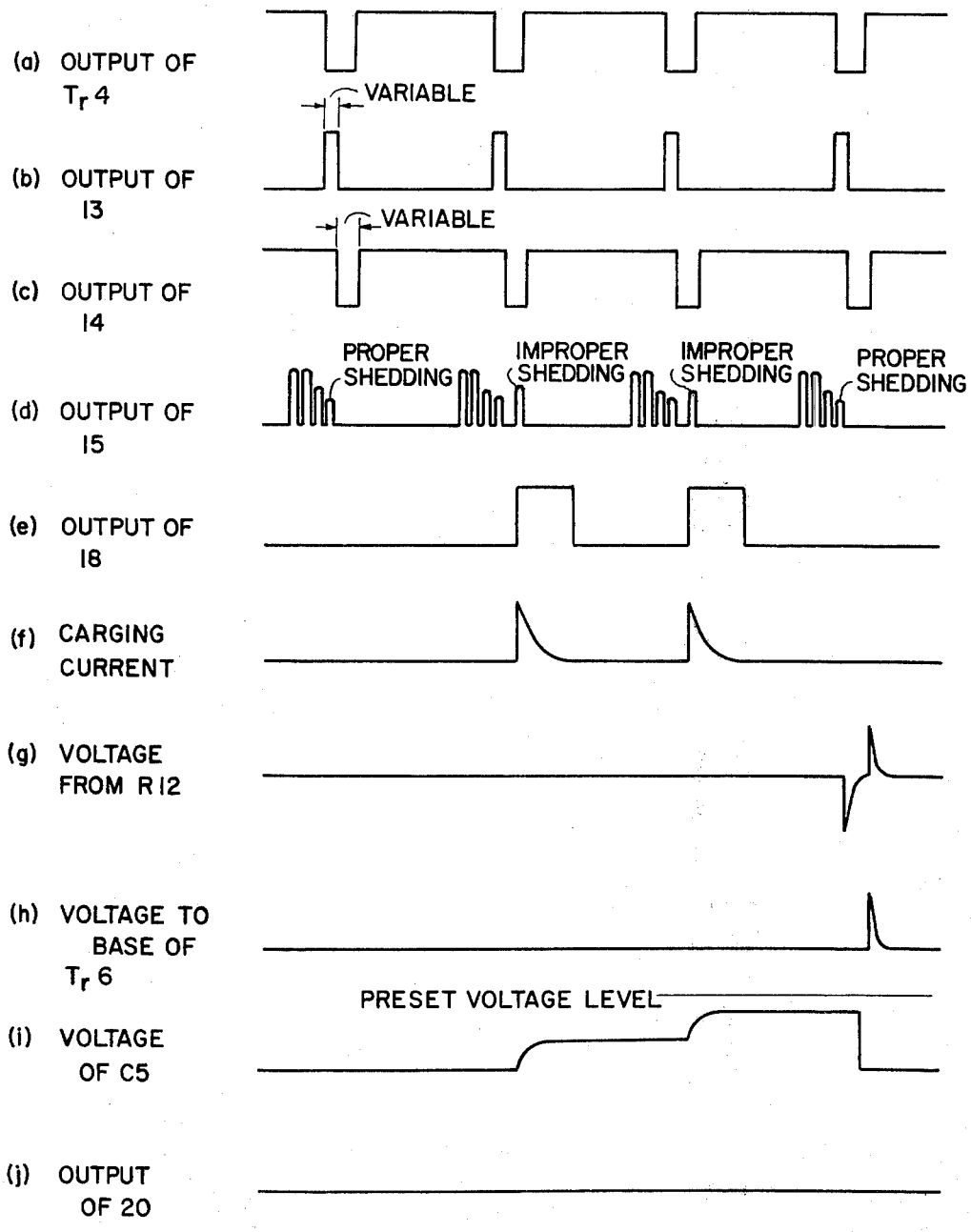

Referring to FIG. 6, the operation of the system where the warp detected signals due to the improperly shedded warp are not provided for three or more consecutive motion periods will be described in the following. Although FIG. 6 illustrates wave forms of successively incoming warp detected signals similar to FIG. 5, the third successive warp detected signal is not received. Because of the absence of the third warp detected signal, no corresponding output is obtained from the wave shaping circuit 20, so that the transistor T*r*5 remains off during that period. Therefore, the positive going component shown in FIG. 6(*h*), of the differentiated output from the capacitor C6, shown in FIG. 6(*g*), is applied to the base electrode of the transistor T*r*6, thereby turning it on. Since the transistor T*r*6 is turned on, the quantity of electricity charged in the capacitor C5, by the two successive incoming signals, is discharged through the transistor T*r*5 without the charging voltage reaching the preset level. As a result, the initial condition is restored.

As described in the foregoing, according to the preferred embodiment of the present invention, the opening period of the timing gate, corresponding to the opening of the timing switch is delayed by means of a delay circuit such as a single-shoe multivibrator and the like so that malfunction due to the disorder of the warp which occurs in case of the fabrics the warp of which is less easy of shedding can be avoided, with the result that the weaving machine is automatically controlled to stop it, for example, only in case of the improper shedding of the warp. Since the delay time of the delay circuit such as the multivibrator may be readily set by means of a variable resistor, for example, without necessity of changing the structure, shape and/or fixing angle of the cam provided in association with the crank shaft, the detection range can be set as desired with extreme ease, depending upon the kind and nature of the warp to be used for the fabrics. Since a predetermined number of consecutively incoming warp detected signals are adapted to be accumulated by means of an accumulating means such as a capacitor, an automatic control of the present invention can be effected irrespective of the motion speed of the weaving machines. Such a predetermined number of the consecutive incoming signals can be readily set by means of the variable resistor.

In the foregoing embodiment, the threshold for the accumulated value was so chosen that three or more consecutive warp detecting signals due to improperly shedded warp make the accumulated value exceed the threshold or the preset value, thereby to control the weaving machine. Needless to say, however, such threshold or preset value should be changed depending upon the nature and the kind of the fabrics to be woven or the required quality of the fabrics.

In the foregoing embodiment, the opening signal mechanically obtained by means of the timing switch was utilized to trigger the delay circuit. Alternatively, however, such a timing signal can be obtained by withdrawing the warp detected signal obtainable when the reed and thus the light beam of the photoelectric detecting scheme crosses the warp line as shedded so that the warp line detected signal, at that timing, triggers the delay circuit. More specifically, the output of the photoelectric device 10 obtainable when the light beam between the light source 9 and the photoelectric device 10 crosses the upper side warp line when the warp is most shedded is withdrawn as the upper side warp line detected signal and is applied to the delay circuit 13 in lieu of the opening signal of the above described timing switch 12. The delay circuit 13 is triggered by the above described upper side warp line detected signal, and provides an output pulse which falls at the predetermined rotational angle (80° or 90°) of the crank shaft 6, while the subsequent delay circuit 14 is triggered in response to the fall of the pulse output, whereby the system operates in substantially the same manner as described in conjunction with the foregoing embodiment. According to the last described embodiment, no mechanical timing switch is necessary, resulting in simplicity of structure of the system.

Figure 7:
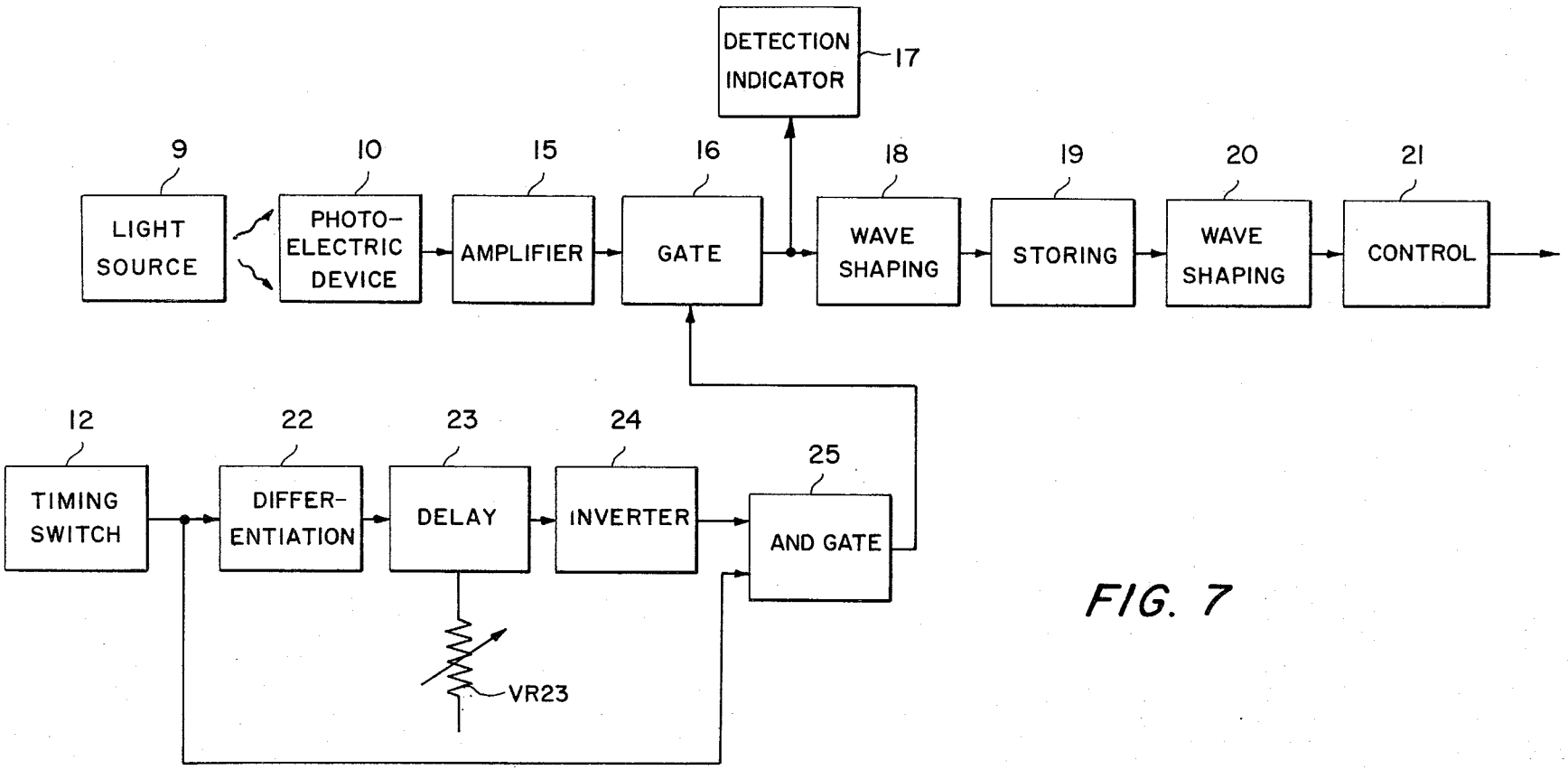
FIG. 7 is a block diagram of another embodiment of the present invention.

FIG. 7 is a block diagram of another embodiment of the present invention. The major portion of the FIG. 7 embodiment is substantially the same as the FIG. 3 embodiment. Therefore, only a different portion of the FIG. 7 embodiment will be described in the following. The timing pulse obtainable from the timing switch 12, at high level during the opening period of the switch, is applied to the differentiation circuit 22 and is also applied to the AND gate 25. The differentiation circuit 22 differentiates the timing pulse to provide a differentiated output at the leading edge of the time pulse, i.e. at the beginning timing of the opening of the timing switch 12. The differentiated output is applied to the delay circuit 23. The delay circuit 23 comprises a singleshot multivibrator which is triggered by the output from the differentiation circuit 22 to provide an output pulse the width of which is variable by means of a variable resistor VR23, for example. The output from the delay circuit 23 is applied to an inverter 24 which provides an inverted output which is applied to the said AND gate 25. Therefore, the AND gate 25 provides an output the leading edge of which is variable and the trailing edge of which is fixed, and this output is applied to the gate circuit 16 as a gate control signal. Since the other circuit configuration of the FIG. 7 embodiment is the same as that of the FIG. 3 embodiment, repeated description is therefore omitted.

Figure 8:
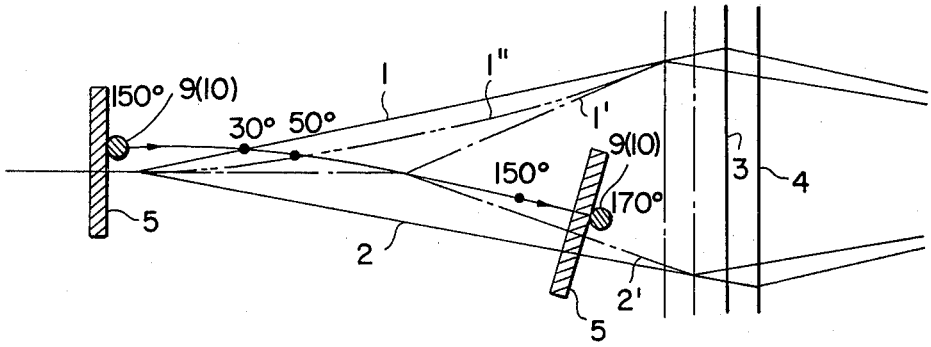
FIG. 8 is an illustration showing a detection range by means of the photoelectric detecting scheme of the FIG. 7 embodiment.

FIG. 8 shows a detection range by the photoelectric detecting scheme of the FIG. 7 embodiment and corresponds to the FIG. 2. illustration.

Figure 9:
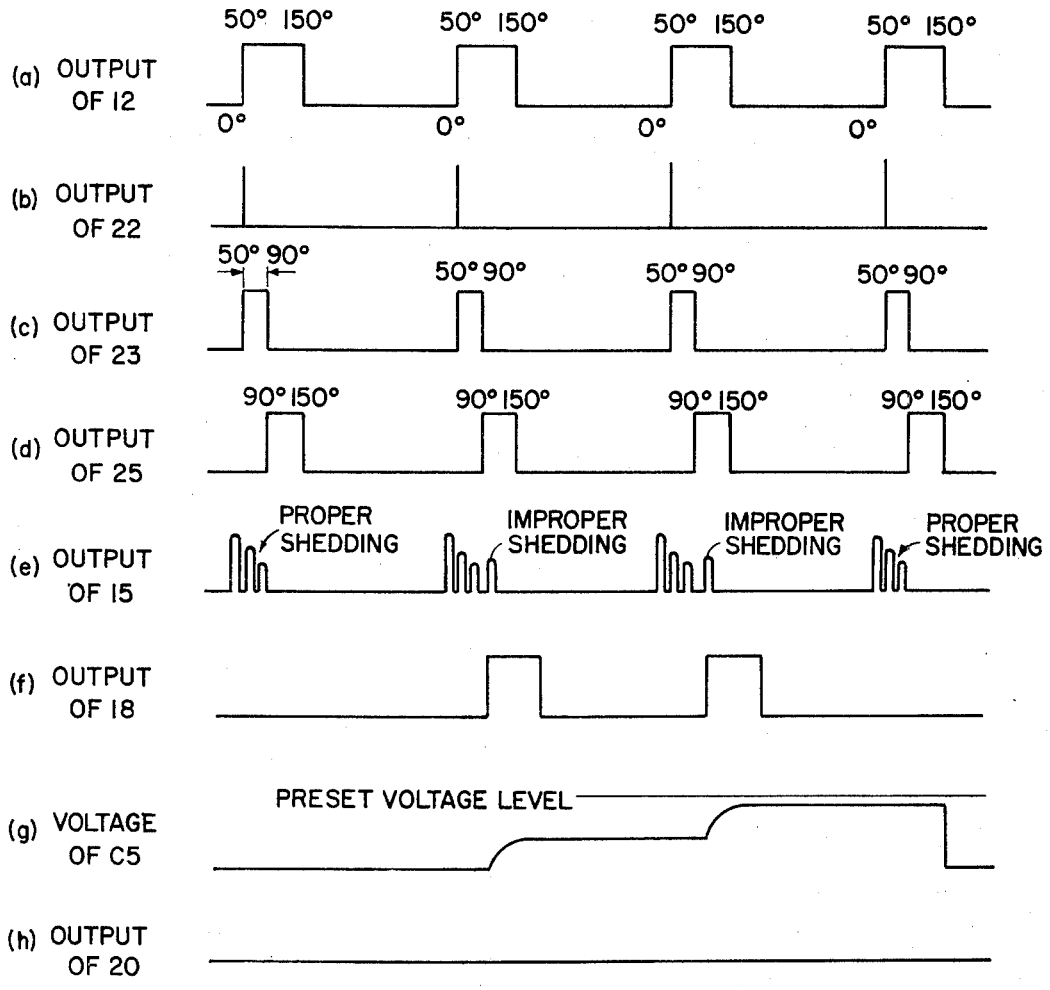
FIGS. 9 and 10 illustrate wave forms of the signals at various portions of the FIG. 7 embodiment for the purpose of explaining the operation thereof.

FIG. 9 shows a timing chart of the signals in the FIG. 7 embodiment. It is pointed out that in FIG. 9 the inventive system has been intended to be responsive to two or more consecutive improper sheddings of the warp. Now, operation of the FIG. 7 embodiment will be described with reference to FIG. 9.

When the rotational angle of the crank shaft 6 (FIG. 1) reaches 50°, the timing switch 12 is opened as a function of the cam 11, and when the rotational angle becomes 150° the timing switch 12 is again closed as a function of the cam 11. Accordingly, a timing pulse, as shown in FIG. 9(*a*), is obtained from the timing switch 12 during the opening period of the timing switch. Therefore, the differentiated output from the differentiation circuit 22, as a result of differentiation of the leading edge of the timing pulse shown in FIG. 9(*b*), is obtained at the time the rotational angle is 50°, and is applied to the delay circuit 23 such as a single-shot multivibrator to trigger it.

The delay time of the delay circuit 23, i.e. the width of the output pulse thereof is selected to cover the range where the photoelectric detecting scheme (9 and 10) does not detect the warp which might have been suspended irrespective of the proper shedding of the warp. In the embodiment shown, the pulse width of the output from the delay circuit 23 has been selected to be about 40° (90° to 50°) in terms of the angle of the crank shaft. Accordingly, the delay circuit 23 is triggered at the angle 50° by the differentiated output from the differentiation circuit 22 and is adapted to be reset at the angle 90°, thereby to provide the pulse output of the pulse width of 40° as shown in FIG. 9(*c*). The output from the delay circuit 23 is inverted by the inverter 24 and is applied to a second input of the AND gate 25, as shown in FIG. 9(*a*). Therefore, the AND gate 25 provides an output pulse as shown in FIG. 9(*d*) which pulse width has been made smaller or delayed at the leading edge thereof by 40° in terms of the crank shaft angle as compared with the original timing pulse. The output pulse from the AND gate 25 serves as the gate control signal of the gate circuit 16.

On the other hand, the output from the photoelectric device 10 and thus from the amplifier 15 might comprise the warp detected signal due to the disorder of the warps 1 even in case of the proper shedding of the warp, as shown in FIG. 9(*e*). But the gate circuit 16 is opened with about 40° delay as compared with the beginning of the opening of the timing switch 12. Therefore, the warp detected signal in case of the proper shedding of the warp is interrupted by the gate circuit 16. Now assuming that the warp detected output is obtained from the amplifier 15 after the crank shaft angle 90° is reached, it is apparent that this warp detected signal is the warp detected signal obtainable due to the improper shedding of the warp. This improper shedded warp detected signal is obtained during the opening of the gate circuit 16, so that it is applied to the wave shaping circuit 18 through the gate circuit 16 to trigger it and is also applied to the indicator 17. The indicator 17 is thus energized to indicate that the improper shedding of the warp was detected. The wave shaping circuit 18 provides a pulse output which rises in response to the improper shedding warp detected signal and falls after a predetermined pulse width, as shown in FIG. 9(*f*), which output is applied to the storing circuit 19.

Therefore, the storage circuit 19 comprising a storing capacitor or the like cumulatively stores the output pulses obtainable from the wave shaping circuit 18. However, the storing circuit 19 has been adapted so that it provides an output when three or more incoming pulses are cumulatively stored. Therefore, if and when only two consecutive improper shedding warp detected signals are obtained, the cumulatively stored voltage does not reach the above described preset voltage level or threshold level, as shown in FIG. 9(*g*). Accordingly, no output for triggering the wave shaping circuit 20 is obtained and no pulse output is obtained from the wave shaping circuit 20, as shown in FIG. 9(*h*). Therefore, the weaving machine control circuit 21 does not stop the weaving machine and the weaving machine continues to operate. Preferably, the preset voltage level of the storing circuit 19 may be variable by means of a variable resistor, for example, to set the level as desired, whereby the number of consecutive pulses to which the storing circuit 19 is responsive may be changed as desired.

Figure 10:
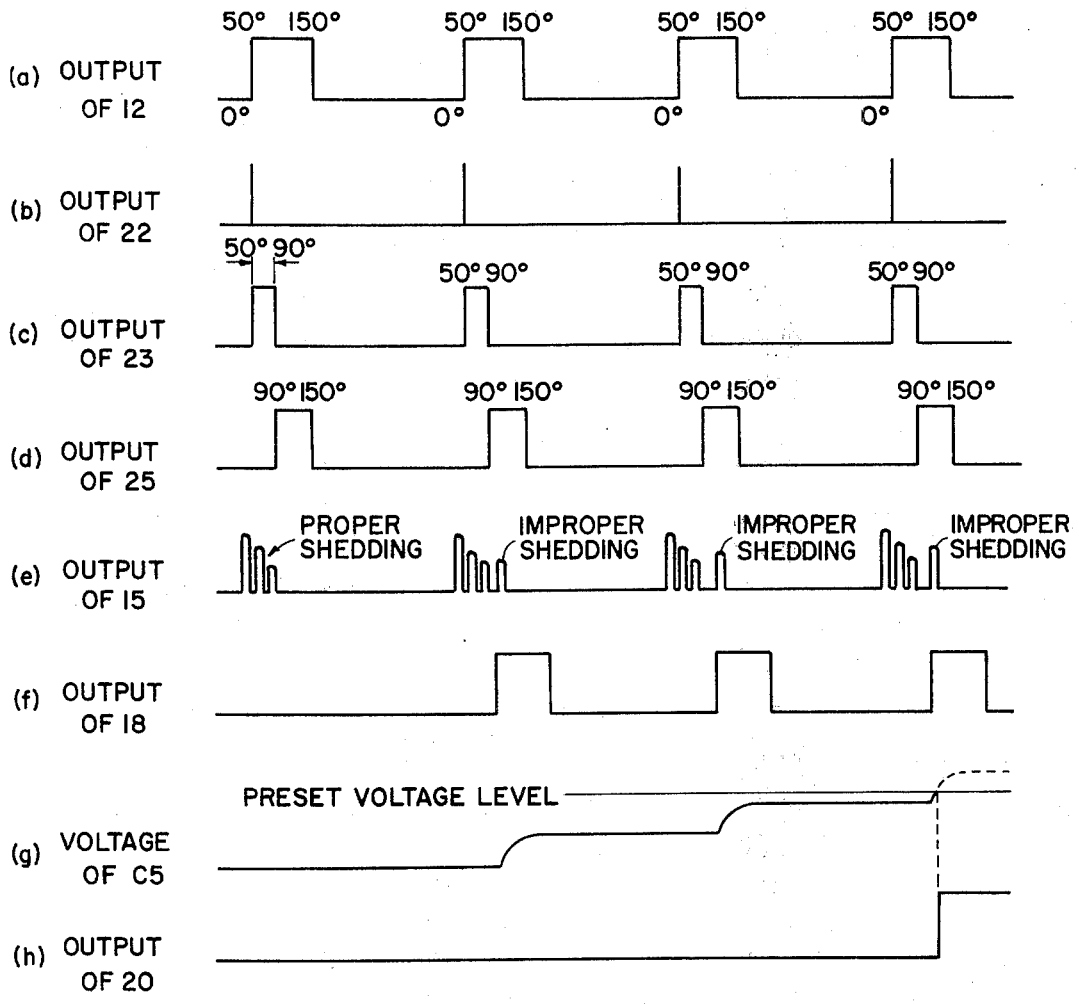

Now referring to FIG. 10, description will be made of the operation of the embodiment in a situation where three or more improper shedding warp detected signals are obtained. In such a situation, the storing circuit 19 stores the three consecutive pulse outputs from the wave shaping circuit 18, as shown in FIG. 9(*g*). Accordingly, the charge voltage or store voltage of the storing circuit 19 exceeds the above described preset voltage level. Therefore, an output is obtained from the storing circuit 19 which triggers the subsequent stage wave shaping circuit 18. Therefore, the wave shaping circuit 20 provides a control pulse as shown in FIG. 10(*h*) and the control circuit 21 responds to the pulse to stop the operation of the weaving machine.

Figure 11:
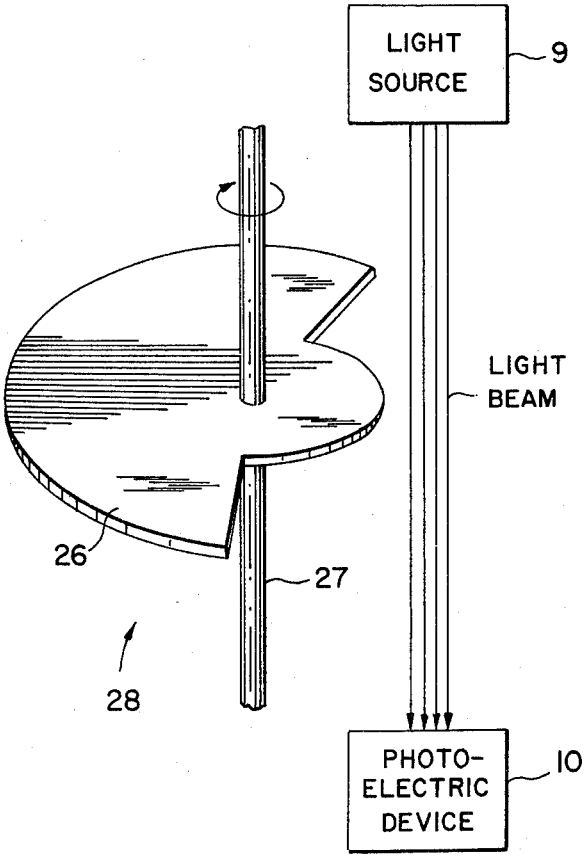
FIG. 11 is a diagrammatical view of a modified timing switch for use in the present invention.

FIG. 11 is a diagrammatical view of a preferred embodiment of the timing switch for use in the inventive apparatus. The timing switch 28 may be employed in lieu of the cam 11 and switch 12 in FIG. 1. The timing switch 28 comprises a shutter 26 formed on a rotational shaft 27 operatively coupled to the crank shaft (not shown) such that the light beam from the light source 9 to the photoelectric device 10 is interrupted as the shutter 26 rotates. More specifically, the shutter 26 is rotated in the arrow direction as the crank shaft rotates and the light beam from the light source 9 is interrupted at the large diameter portion of the shutter 26, while the light beam from light source 9 is allowed to impinge upon the photoelectric device 10 at the notch portion of the shutter 26, thereby to cause the photoelectric device 10 to provide a timing pulse. This type of the timing switch facilitates the setting of the pulse width and the phase of the timing pulse, thereby to assure the operation of the apparatus. Further, this type of the timing switch enables the sensitivity test and the operation test even during the interruption of the operation of the weaving machine.

According to the above described embodiment, the detection starting time of the improper shedding of the warp can be changed to the optimum condition, depending upon the easiness of the shedding of the warp of the fabric to be woven or the characteristic of the weaving machine, and the detection terminating time is fixedly determined by a mechanical timing switch, so that various tests can be done even during the stoppage of operation of the weaving machine, with the result that there is provided an automatic control apparatus for a weaving machine easy of operation and adjustment and simple in construction.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. An automatic control apparatus for a weaving machine wherein warp is shedded for each weaving operation comprising;

means for detecting improperly shedded warp, means responsive to said weaving operation for generating a timing signal at a predetermined phase of said weaving operation, means responsive to said timing signal for providing a gate control signal, said gate control signal having a predetermined phase, with respect to said weaving operation, defined by the leading and trailing edges thereof, means provided in operative association with said gate control signal providing means for setting said phase of said gate control signal, means responsive to said gate control signal for gating an output from said warp detecting means, and means responsive to an output from said gating means for automatically controlling the on-off operation of said weaving machine.

2. An automatic control apparatus for a weaving machine in accordance with claim 1, in which said gate control signal providing means comprises means responsive to said timing signal for defining the leading edge of said gate control signal.

3. An automatic control apparatus for a weaving machine in accordance with claim 2, in which said leading edge defining means comprises means responsive to said timing signal for delaying the leading edge of said gate control signal.

4. An automatic control apparatus for a weaving machine in accordance with claim 3, in which said leading edge delaying means comprises a single-shot multivibrator responsive to said timing signal to be triggered.

5. An automatic control apparatus for a weaving machine in accordance with claim 3, in which said gate control signal providing means further comprises means responsive to an output from said delay means and said timing signal for forming said gate control signal.

6. An automatic control apparatus for a weaving machine in accordance with claim 2, in which said gate control signal providing means further comprises means responsive to said timing signal for defining the trailing edge of said gate control signal.

7. An automatic control apparatus for a weaving machine in accordance with claim 6, in which said trailing edge defining means comprises means responsive to an output from said leading edge defining means for delaying the trailing edge of said gate control signal.

8. An automatic control apparatus for a weaving machine in accordance with claim 7, in which said trailing edge delaying means comprises a single-shot multivibrator responsive to said output from said leading edge defining means to be triggered.

9. An automatic control apparatus for a weaving machine in accordance with claim 1, said control means comprises means for accumulating said warp detected signals as gated by means of said gating means, and means responsive to an output from said accumulating means for stopping the operation said weaving machine.

10. An automatic control apparatus for a weaving machine in accordance with claim 9, in which said control means further comprises means for threshold detecting said output from said accumulating means.

11. An automatic control apparatus for a weaving machine in accordance with claim 9, in which said accumulating means comprises means for storing an electric charge.

12. An automatic control apparatus for a weaving machine in accordance with claim 9, in which said accumulating means comprises means responsive to said warp detected signals as gated by means of said gating means for generating a pulse output of a predetermined pulse width, and means for storing an electric charge to be supplied by said pulse output of said predetermined pulse width.

13. An automatic control apparatus for a weaving machine in accordance with claim 1, in which said timing signal generating means comprises an electric switch having an actuator and a cam provided in operative association with said weaving machine operation for actuating said actuator, the geometry of said cam defining said predetermined phase of said weaving operation.

14. An automatic control apparatus for a weaving machine in accordance with claim 1, in which said timing signal generating means comprises a photoelectric detecting means and a shutter provided in operative association with said weaving operation for influencing a light beam of said photoelectric detecting means the geometry of said shutter defining said predetermined phase of said weaving operation.

15. An automatic control apparatus for a weaving machine in accordance with claim 1, in which said timing signal generating means comprises means for detecting the warp as shedded.

* * * * *

UNITED STATES PATENT AND TRADEMARK OFFICE

CERTIFICATE OF CORRECTION

PATENT NO. : 3,989,068

DATED : November 2, 1976

INVENTOR(S) : Arao Kakinaka

It is certified that error appears in the above-identified patent and that said Letters Patent are hereby corrected as shown below:

Column 1, line 5, after "an" insert --on-off--;
Column 1, line 38, "healds" should be --heads--;*
Column 1, line 58, "forth" should be --one fourth--.*
Column 2, line 13, "line" should be --lines--;*
Column 2, line 47, "sheaded" should be --shedded--.
Column 3, line 55, delete "which".
Column 4, line 20, delete "; and";
Column 4, line 31, delete "to";
Column 4, line 44, "and the" should be --with--;
Column 4, line 44, "with" should be --and the--;
Column 4, line 51, "1" should be --11--.
Column 5, line 60, after "C6" insert --and--;
Column 5, line 60, "and a" should be --. A--.
Column 6, line 61, delete "the" (fourth occurrence).
Column 6, line 61, after "proper" insert --shedding--.
Column 8, line 14, "shoe" should be --shot--.
Column 8, line 53, "of" should be --from--.
Column 9, line 14, "timing" (first occurrence) should be --time--;
Column 9, lines 16 and 17, "singleshot" should be --single-shot--.
Claim 9, line 30, after "operation" insert --of--.*

Signed and Sealed this

Eighth Day of March 1977

[SEAL]

*Attest:*

RUTH C. MASON
*Attesting Officer*

C. MARSHALL DANN
*Commissioner of Patents and Trademarks*